US007413095B2

(12) United States Patent
Bertani et al.

(10) Patent No.: US 7,413,095 B2
(45) Date of Patent: Aug. 19, 2008

(54) VANDAL RESISTANT LOCKING CAP WITH LIMITED TIGHTENING TORQUE

(75) Inventors: Alberto Bertani, Milan (IT); Michele Girino, Frassineto Po' (IT)

(73) Assignee: Elesa S.p.A., Milan (IT)

( * ) Notice: Subject to any disclaimer, the term of this patent is extended or adjusted under 35 U.S.C. 154(b) by 786 days.

(21) Appl. No.: 10/954,890

(22) Filed: Sep. 30, 2004

(65) Prior Publication Data

US 2005/0077262 A1 Apr. 14, 2005

(30) Foreign Application Priority Data

Oct. 9, 2003 (IT) ..... MI2003A1945

(51) Int. Cl.
*B65D 51/18* (2006.01)
*B65D 55/02* (2006.01)
*B65D 55/14* (2006.01)
*B65D 41/04* (2006.01)

(52) U.S. Cl. ..... 220/210; 220/254.8; 220/259.4; 215/207; 215/901

(58) Field of Classification Search ..... 215/207, 215/218, 219, 330, 334, 901; 220/210, 288, 220/2.88, 259.4, 284, 253, 254.8
See application file for complete search history.

(56) References Cited

U.S. PATENT DOCUMENTS 2,772,803 A * 12/1956 Pasquariello ..... 215/219
3,160,301 A * 12/1964 Milbourne ..... 215/219
3,396,864 A 8/1968 Jones et al.
3,426,932 A * 2/1969 Rouse ..... 215/207
4,854,459 A * 8/1989 DeJonge ..... 215/220
5,158,194 A 10/1992 Sirgo et al.
5,344,035 A * 9/1994 Manera ..... 215/219
5,586,670 A * 12/1996 Greenwald ..... 215/207
5,765,706 A * 6/1998 Barker et al. ..... 215/230
5,873,475 A * 2/1999 Volpe ..... 215/207
6,082,564 A * 7/2000 Trout ..... 215/207
7,043,945 B2 * 5/2006 Hollingsworth ..... 70/16

FOREIGN PATENT DOCUMENTS

DE 7305443 U 6/1973
EP 0381494 A2 8/1990
EP 1522500 A1 4/2005

* cited by examiner

*Primary Examiner*—Anthony D Stashick
*Assistant Examiner*—Niki M. Eloshway
(74) *Attorney, Agent, or Firm*—Pearne & Gordon LLP

(57) ABSTRACT

A device for closing, connecting and/or locking including a driving element and a driven element having a threaded end. The driven element is at least partially positioned within the driving element. An axial anchoring structure axially anchors the driving element to the driven element while allowing rotation of the driving element and the driven element. A rotational anchoring structure anchors the driving element to the driven element for unitary rotation in a first rotation direction, only up to a limited tightening torque. The rotational anchoring structure allows the free rotation of the driving element in a second rotation direction opposite to the first rotation direction. A locking structure locks the driving element with driven element for unitary rotation in the second rotation direction.

18 Claims, 2 Drawing Sheets

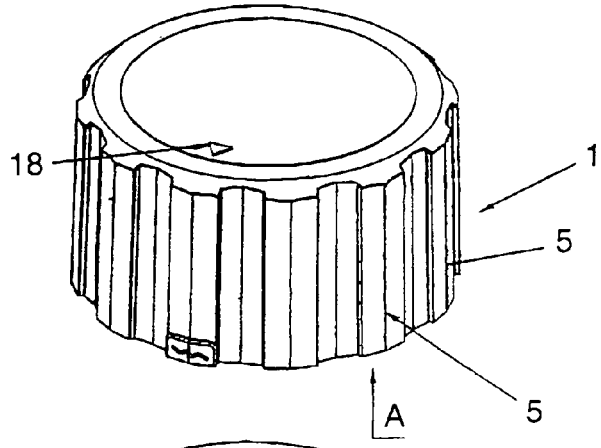
Fig. 5
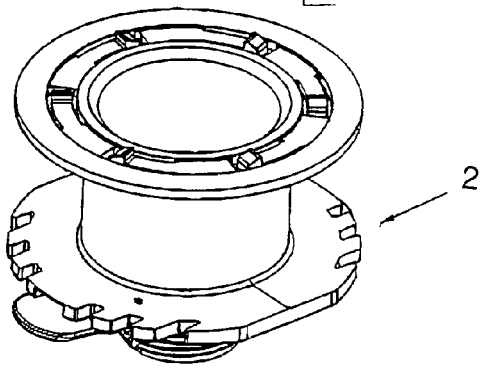
Fig. 6
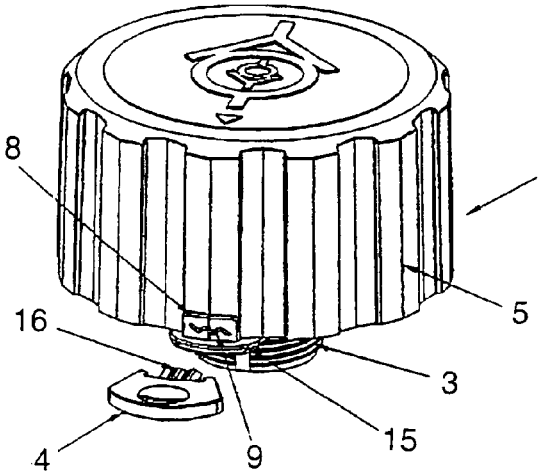
Fig. 7
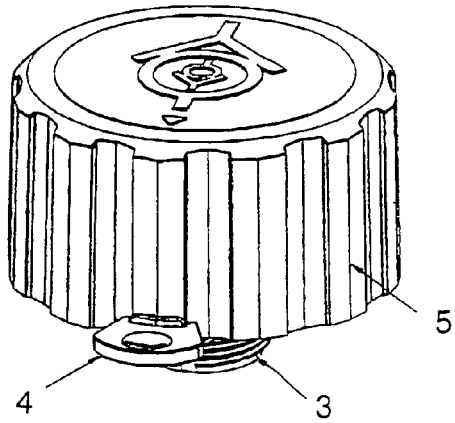

VANDAL RESISTANT LOCKING CAP WITH LIMITED TIGHTENING TORQUE

BACKGROUND OF THE INVENTION

The present invention relates to a closing, connecting and/or locking safety device, the locking occurring up to a limited tightening torque, said device also preventing non-destructive forced opening.

In particular, the invention relates to a safety cap capable of resisting non manifest acts of vandalism, wherein opening by unauthorized persons is nearly impossible ("vandal-resistant") and wherein the tightening torque may at the same time be prevented from exceeding a threshold value (limited torque) during closure. A suitable threshold value is established during the designing phase in order to achieve a good seal without damaging the cap gasket. There is a need for a cap of this kind to close oil and/or fuel tanks of outdoor-operating equipment, (for example on a building site, on premises unprotected from incursions by prowlers), for example earthmovers, road machines, agricultural equipment, and other such equipment.

However, the invention may also be applied in other fields. For example, the device according to the invention is ideally suited to the fixing of swimming pool cover edges, the unauthorized or accidental removal of which is thereby effectively prevented, with remarkable safety advantages. The present invention provides a valuable and practical solution for the closure of holes and openings, the connection of co-axial elements or parts, and the locking or fixing of any kind of structure in many other applications requiring both limited tightening torque and prevention of non-destructive forced opening.

Further, vandal-resistant caps for tanks, which achieve the object through a keylock, are well known. Since a torque limiting device is not provided in these known devices, the torque applied during manual tightening is extremely discretionary, which causes an evident risk of deformation of the gasket, resulting in possible leakage of the tank contents. Moreover, in other known caps, substantially comprising two component parts (threaded connection and bell-shaped cap), opening is performed by unscrewing the caps only using a suitable key. These caps, however, are not really safe from acts of vandalism because, by applying adequate pressure to the bell-shaped element gripped during such operation, it is equally possible to unscrew the cap, due to the friction between the contact surfaces of the two elements. Furthermore, when operation of the cap is performed with a plastic key, the key itself may easily break. In similar known devices problems of the same kind exist. Moreover, the key shape in known devices allows the insertion in the seat of the key of ordinary tools too, such as screwdrivers, so that opening may still occur without the proper key.

BRIEF SUMMARY OF THE INVENTION

The present invention provides a device for closing, connecting and/or locking comprising: a driving element; a driven element comprising a threaded end, wherein the driven element is positioned at least partially within the driving element; axial anchoring means for axially anchoring the driving element to the driven element while allowing rotation of the driving element and the driven element; rotational anchoring means for anchoring the driving element to the driven element for unitary rotation in a first rotation direction, only up to a limited tightening torque, the rotational anchoring means allowing the free rotation of the driving element in a second rotation direction opposite to the first rotation direction; and locking means for locking the driving element with driven element for unitary rotation in the second rotation direction.

BRIEF DESCRIPTION OF THE DRAWINGS

The invention will now be described in greater detail in the following, with reference to the accompanying drawings, which illustrate an example embodiment of a vandal-resistant cap representing an example in which the invention is effectively embodied. In the drawings:

FIG. 5 is an exploded perspective view of the vandal-resistant cap of FIGS. 1 to 3; and FIG. 6 is a perspective view of the cap of FIGS. 1 to 5 in a mounted condition and with the opening key not inserted; and FIG. 7 is a perspective view of the cap of FIGS. 1 to 5 in a mounted condition and with the opening key inserted.

DETAILED DESCRIPTION OF THE INVENTION

With reference to the drawings, the illustrated device according to the invention comprises, as mentioned, a vandal-resistant cap. However, the device according to the invention may be a device other than a cap and have functions other than those of a cap.

Figure 1:
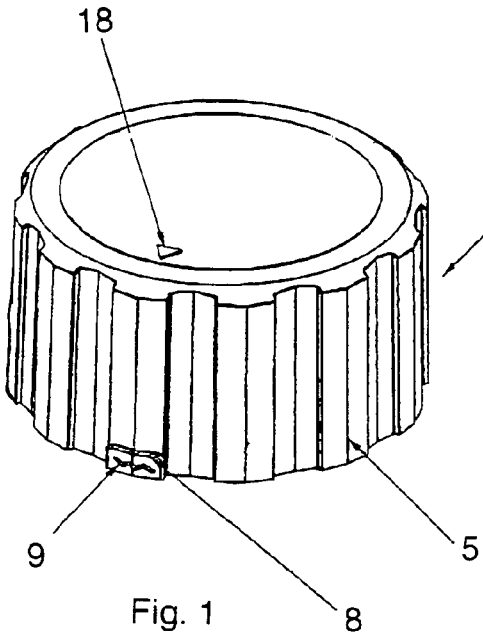
FIG. 1 is an external perspective view of a bell-shaped driving element of the vandal-resistant cap according to the present invention.
Figure 2:
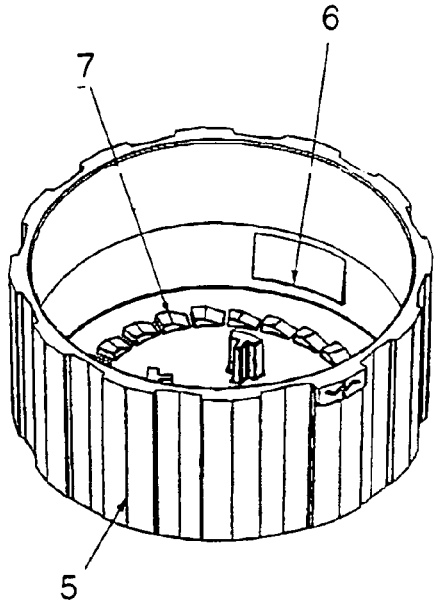
FIG. 2 is a perspective view illustrating the inside of the driving element of FIG. 1.
Figure 3:
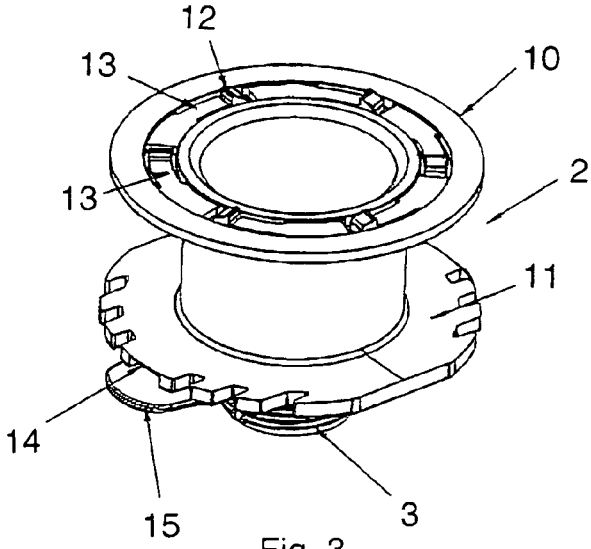
FIG. 3 is an external perspective view of an driven element of the vandal-resistant cap according to the invention.
Figure 4:
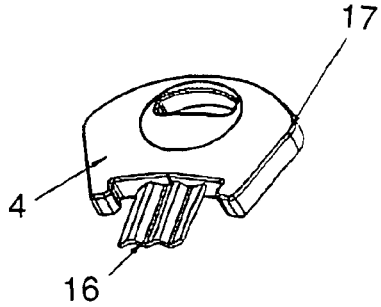
FIG. 4 represents an enlarged perspective view of a key for the vandal-resistant cap of FIGS. 1 to 3.

The vandal-resistant cap shown in the accompanying drawings, has a generally cylindrical structure, comprises a bell-shaped driving element 1 (FIGS. 1 and 2), an driven element 2 with a threaded end 3 (FIG. 3), to be coaxially inserted in the driving element 1. The vandal-resistant cap also includes a key 4 (FIG. 4) capable of making the driving element 1 and the driven element 2 rotate together upon reaching a specific position, as better described in the following. The driving element 1 and the driven element 2 may both be made of a technopolymer, or alternatively of any suitable material such as a thermoplastic, a thermoset plastic, or the like.

The bell-shaped driving element 1 comprises, on the outer surface of the side wall thereof, a plurality of ribs 5 according to the generatrixes thereof, whose shape has been carefully studied in order to provide an excellent grip for the hand of the operator operating the vandal-resistant cap. Other suitable gripping structures can be provided on the outer surface of the driving element 1.

The driving element 1 provides one or more yielding protrusions 6 on the inner surface of the side wall thereof; the yielding protrusions 6 have an oblique surface, ending flush with the wall on its downward-facing side (in respect of FIG. 5) and forming an undercut on the opposite side. The driving element 1 further comprises, on the inner surface of the base thereof, a fixed crown of equally-distanced driving teeth 7. The driving teeth 7 have beveled sides having a slope in a clockwise direction that is different than a slope in the counterclockwise direction, for the purpose described in more detail below.

Further, the driving element 1 further has an outer protrusion 8 crossed by a thin slit 9 having a contoured profile. The outer protrusion 8 is located at the periphery of the side wall of the driving element 1, on the side opposite to the base.

The driven element 2 comprises a central cylindrical body with two flanges 10 and 11, at the upper and lower end, respectively, from the second of which the threaded end 3 protrudes. The first flange 10 carries a crown of driven teeth 12, similar to the driving teeth 7, also having beveled sides with a slope in a clockwise direction that is different than a slope in the counterclockwise direction, and formed at the end of cantilevered flexible arms 13. A gauged radial cavity 14 and a corresponding wider guide protrusion 15 are provided in the second flange 11, serving as an index, the function of which is described in detail below.

In the present embodiment, the key 4 comprises a simple, thin, profiled blade 16 made of a special steel. The profile of the blade 16 matches or is complementary to that of the thin, profiled slit 9 of the outer protrusion 8 of the driving element 1. The slit 9 serves as a seat for the blade 16. The key is further equipped with a plastic handle 17, capable of accommodating the outer protrusion 8 at its center and to be inserted by means of two lateral teeth into the recesses between two of the ribs 5 adjacent to the outer protrusion 8 of driving element 1.

An index mark 18 of the position of the outer protrusion 8 can be provided on the outside of the base of driving element 1. Furthermore, known types of air valves (not shown) can be provided in the vandal-resistant cap for the inflow and outflow of air from the tank onto which the vandal-resistant cap is mounted.

To mount the vandal-resistant cap according to the invention, the driven element 2 is inserted, as shown by arrow A of FIG. 5, into the cavity of the bell-shaped driving element 1. The driving element 1 receives the driven element 2 coaxially so that only the threaded end 3 protrudes (FIGS. 6 and 7). After insertion of the driven element 2 into the driving element 1 in an axial direction, the elements 1, 2 are effectively anchored, one to the other, by the snap-fit engagement of the undercut edge of the yielding protrusions 6 underneath the first flange 10 of the driven element 2. Such snap-fit engagement is possible due to the elastic deformation of the yielding protrusions 6. In this way, the yielding protrusions 6 and the first flange cooperate to serve as an axial anchoring means for axially anchoring the driving element to the driven element while allowing rotation of the driving element and the driven element.

Once the driven element 2 is inserted into driving element 1, the driving teeth 7 of the driving element 1 engage with the driven teeth 12 of the first flange 10. Due to the side bevels of the driving teeth 7 and driven teeth 12 having different slopes in each direction, when the driving element 1 of a mounted cap is turned in one direction (usually a clockwise rotation for screwing or tightening), the bevels of the driving teeth 7 having the steeper slope rest on the bevels of the driven teeth 12 having the steeper slope, so that the latter is driven, together with the first flange 10, effectively causing elements 1 and 2 to be fixedly connected or anchored for unitary rotation in this direction. This driving action may continue as long as the tightening torque keeps below a threshold value (limited torque), beyond which the steep bevels between the driving teeth 7 and the driven teeth 12 slide the one onto the other forcing the flexible arms 13 to flex inwards of the first flange 10, making the elements 1, 2 free to reciprocally rotate.

When the driving element 1 rotates in the other direction, (usually a counterclockwise rotation of the driving element 1, tending to unscrew or unlock the vandal-resistant cap) the driving teeth 7 slide effortlessly on the driven teeth 12, still due to flexure of the arms 13 and, in this case, to the teeth bevels, having a gentler slope in this direction. As a consequence, the rotation of the driving element 1 will not be able to drive into rotation the driven element 2, which will remain stationary preventing, as desired, access to the tank.

Due to this arrangement, the mounted cap (FIG. 6) can be screwed on or tightened, rotating the driving element 1 thereof, for example in a clockwise direction, until closure of the tank filling hole for which it is provided, the inner wall of which will comprise a threading matching the threading of the threaded end 3. The seal will usually be enhanced by a gasket (not shown) applied under the second flange 11 (see FIG. 3) and will be further enhanced by the correct tightening of the vandal-resistant cap of the invention. The limited tightening torque will in fact be established according to the prescribed gasket hardness during the designing and trial phase, the torque relying on the particular cooperation between the driving and driven teeth 7, 12, depending on the slope of the respective bevels thereof and on the degree of yielding of the flexible arms 13 carrying the driven teeth 12. Further, when rotating the driving element 1 and the tightening torque deemed correct (limited torque) is exceeded, the flexible arms 13 yield, bending, and the driving teeth 7 slide over the driven teeth 12, so that the further rotation of the driving element 1 corresponds to no further angular advancement of the driven element 2. Thus, the driving teeth 7, the driven teeth 12, and the flexible arms 13 cooperate to serve as rotational anchoring means for anchoring the driving element 1 to the driven element 2 for unitary rotation in the tightening direction, only up to a limited tightening torque, while allowing the free rotation of the driving element 1 in the unscrewing direction.

Once the vandal-resistant cap according to the invention is thus screwed on so that it correctly performs its closing function, it is not possible to unscrew the cap to free the opening (filling hole) closed thereby. By rotating the driving element 1 in a counterclockwise direction, the cap idles and does not drive into rotation the driven element 2, since the driving teeth 7 slide on the driven teeth 12 due to the gentle slope of the teeth sides in this rotation direction. This operation resists acts of vandalism and unauthorized access to the container onto which the cap according to the invention is mounted.

However, when cap removal is required, the operation can be performed very simply by authorized persons possessing the key 4. For such purpose, it is sufficient to rotate the driving element 1 until the outer protrusion 8, indicated by the index mark or arrow 18 is aligned with the guide protrusion 15 of the driven element 2, which acts as an index. Then, the blade 16 of the key 4 is inserted into the slit 9 of the outer protrusion 8, so that the blade 16 enters the gauged radial cavity 14 of the driven element 2, which acts as a seat for the blade 16. In this way the driving element 1 and the driven element 2 are immediately fixedly connected for rotation in unison and the vandal-resistant cap may be immediately removed by unscrewing it. Thus, the slit 9, the gauged radial cavity 14, and the blade 16 of the key 4 serve as locking means for locking the driving element 1 with driven element 2 for unitary rotation in the unscrewing direction. The shape of the handle 17 contributes to the firm engagement of the key 4 with the outer protrusion 8 and with the ribs 5 of the driving element 1. The ribs 5 in turn help provide a prompt and efficient engagement.

In the present embodiment, the key 4 has been manufactured to enhance the antivandalism effect, whereby the blade 16 is extremely thin and has a pronounced transverse zigzag profile, shaped so as to match the slit 9 in the outer protrusion 8 of the driving element 1, which is correspondingly shaped. Due to the extreme thinness of the slit 9, it is nearly impossible to insert any other replacement means, such as the tip of a screwdriver, even a thin one, or a knife blade. While makeshift means, such as wire or razor blades, may be insertable, they are ineffective in establishing a sufficient connection between the driving and driven elements 1, 2 to allow them to rotate in unison. Such a connection is instead provided by the blade 16 of the key 4, which, the present embodiment, is made of special steel and is suitably shaped to resist stress, by transmitting the force necessary to unscrew the vandal-resistant cap when the cap engages, once it has passed through the outer protrusion 8 and the gauged radial cavity 14 of the driven element 2. The provision of multiple cavities 14 on the driven element 2, signaled by corresponding guide protrusions 15 and/or index marks 18, may further ease the operation.

As mentioned, the device according to the invention is suited to a number of applications. In the case of the antivandalism cap, it is suitable, as mentioned, for use on oil tanks, for example of earthmovers, agricultural equipment or other vehicles equipped with hydraulic equipment, driving in an environment unprotected from prowlers' incursions. When, during the closing operation, the vandal-resistant cap limited tightening torque has been achieved, it is in fact not possible to further screw or unscrew the cap anymore, making it nearly impossible for an unauthorized person to sabotage the cap. Prowlers will therefore have to renounce the hope to access the contents of the tanks for purposes of vandalism or will have to do so destroying the vandal-resistant cap. In such last case, however, minor damage will be caused, because the operator finding the vandal-resistant cap broken upon resuming work will be induced to verify the extent of the act of vandalism and to remedy thereto, with costs which are in any case much lower than those (replacement or contamination of the tank contents) that may be caused by an unacknowledged act of vandalism.

Of course the operator has instead no problems, when change or topping up of the oil or the like contained in the tank is required, in rotating the vandal-resistant cap in a counterclockwise direction, after having aligned the outer protrusion 8 to the guide protrusion 15 and after having inserted the key 4 with the blade 16 into the slit 9, up to engagement with the gauged radial cavity 14.

As far as such key is concerned, the thin profiled blade of special steel helps provide optimal resistance of the key, both in mechanical terms and in terms of atmospheric agents. The small size and the special shape of the key enable the operator to store it together with the other keys he holds (for example, the ignition keys of the vehicle engine). The provision of a stable engagement between key and cap, provided by the shape of the handle 17, which matches that of the outer ribs 5 of the bell-shaped driving element 1, further provides that the key remains in the position of use even during a possible fast rotation, during unscrewing of the vandal-resistant cap.

It is evident that the device has is applicable to other applications as well, different from those as a vandal-resistant cap, as already mentioned. For such applications, even though it does generally not have the shape and functions of a cap, it concerns closing, fixing or locking devices. The device according to the invention comprises construction features and functional behaviors which do not differ conceptually from those described above, even though the vandal-resistant cap may have a different specific shape and appearance once manufactured.

However, it is understood that other practical embodiments of the device according to the invention are possible, different from those described and illustrated herein. For example, and as mentioned, the gauged radial cavities, such as the gauged radial cavity 14 of the second flange 11 of the driven element 2 capable of receiving the blade 16 of the key 4, can be more than one, means other than the yielding protrusions 6 can be provided to make the driving and driven elements 1, 2 axially connected, the shape of the blade 16 of the key 4 and that of the handle 17 thereof may vary, the outer design of the bell-shaped driving element 1 may be different, and so on. Other changes may be suggested to adapt the device to the individual applications thereof without departing from the scope of protection of the following claims.

What is claimed is:

1. A device for closing, connecting and/or locking comprising:

a driving element;

a driven element comprising a threaded end, wherein the driven element is positioned at least partially within the driving element;

axial anchoring means for axially anchoring the driving element to the driven element while allowing rotation of the driving element and the driven element;

rotational anchoring means for anchoring the driving element to the driven element for unitary rotation in a first rotation direction, only up to a limited tightening torque, the rotational anchoring means allowing the free rotation of the driving element in a second rotation direction opposite to the first rotation direction; and locking means for locking the driving element with driven element for unitary rotation in the second rotation direction, wherein the locking means comprise a key which simultaneously engages the driving element and the driven element in a specific position of the driving element relative to the driven element, fixedly connecting the driving element to the driven element during rotation in the second rotation direction, and wherein the key comprises a thin, profiled, high resistance blade to be inserted in a complementary-shaped seat of the driving element and into a gauged seat of the driven element.

2. The device as claimed in claim 1, wherein the axial anchoring means comprise a yielding protrusion having an oblique surface, the yielding protrusion being formed on the inner wall of the driving element, a first end of the yielding protrusion being flush with the inner wall and a second end of the yielding protrusion having an undercut tooth, the undercut tooth cooperating with a flange of the driven element.

3. The device as claimed in claim 1, wherein the rotational anchoring means comprise a crown of driving teeth associated with the driving element and a crown of driven teeth associated with the driven element, the driving teeth and the driven teeth each comprise beveled sides having a slope in a clockwise direction that is different than a slope in the counterclockwise direction, the driving teeth being capable of engagement with the driving teeth, and a flexible arm carrying each of at least one of the driving teeth and the driven teeth.

4. The device as claimed in claim 3, wherein steeper sides of the driving teeth engage steeper sides of the driven teeth up when the driving element is rotated in the first rotation direction until the limited tightening torque is reached, and wherein less steep sides of the driving teeth oppose less steep sides of the driven teeth when the driving element is rotated in the second rotation direction to allow relative rotation between the driving element and the driven element.

5. The device as claimed in claim 3, wherein the flexible arms are carried by the driven element.

6. The device as claimed in claim 3, wherein the limited tightening torque in the first rotation direction is determined by the slope of steeper sides of the driving teeth and the driven teeth.

7. The device as claimed in claim 3, wherein the limited tightening torque in the first rotation direction is determined by a degree of yielding of the flexible arms.

8. The device as claimed in claim 1, wherein the profiled blade of the key is made of steel.

9. The device as claimed in claim 1, wherein the driving element and the driven element are made of a technopolymer.

10. The device as claimed in claim 1, wherein the driving element is bell-shaped.

11. The device as claimed in claim 1, wherein the device is substantially cylindrical.

12. The device as claimed in claim 1, wherein the driven member is coaxially received in the driving member.

13. A device forclosing, connecting and/or locking comprising:

a driving element;

a driven element comprising a threaded end, wherein the driven element is positioned at least partially within the driving element;

axial anchoring means for axially anchoring the driving element to the driven element while allowing rotation of the driving element and the driven element;

rotational anchoring means for anchoring the driving element to the driven element for unitary rotation in a first rotation direction, only up to a limited tightening torque, the rotational anchoring means allowing the free rotation of the driving element in a second rotation direction opposite to the first rotation direction; and locking means for locking the driving element with driven element for unitary rotation in the second rotation direction, wherein the locking means comprise a key which simultaneously engages the driving element and the driven element in a specific position of the driving element relative to the driven element, fixedly connecting the driving element to the driven element during rotation in the second rotation direction, wherein the key comprises a profiled blade to be inserted in a complementary-shaped seat of the driving element and into a gauged seat of the driven element, and wherein the blade has a transverse zigzag profile.

14. A device for closing, connecting and/or locking comprising:

a driving element;

a driven element comprising a threaded end, wherein the driven element is positioned at least partially within the driving element;

axial anchoring means for axially anchoring the driving element to the driven element while allowing rotation of the driving element and the driven element;

rotational anchoring means for anchoring the driving element to the driven element for unitary rotation in a first rotation direction, only up to a limited tightening torque, the rotational anchoring means allowing the free rotation of the driving element in a second rotation direction opposite to the first rotation direction; and locking means for locking the driving element with driven element for unitary rotation in the second rotation direction, wherein the locking means comprise a key which simultaneously engages the driving element and the driven element in a specific position of the driving element relative to the driven element, fixedly connecting the driving element to the driven element during rotation in the second rotation direction, wherein the key comprises a profiled blade to be inserted in a complementary-shaped seat of the driving element and into a gauged seat of the driven element, and wherein the complementary-shaped seat for the profiled blade of the key is a slit provided in an outer protrusion located external to a periphery of the driving element and wherein the gauged seat for the profiled blade of the key is a gauged radial cavity of the driven element.

15. The device as claimed in claim 14, wherein the gauged radial cavity is provided in a second flange of the driven element, the second flange has a protrusion below the second flange, the protrusion serving as index.

16. The device as claimed in claim 14, wherein an index mark corresponding to a position of the outer protrusion of the driving element is provided externally on a base of the driving element.

17. A device for closing, connecting and/or locking comprising:

a driving element;

a driven element comprising a threaded end, wherein the driven element is positioned at least partially within the driving element;

axial anchoring means for axially anchoring the driving element to the driven element while allowing rotation of the driving element and the driven element;

rotational anchoring means for anchoring the driving element to the driven element for unitary rotation in a first rotation direction, only up to a limited tightening torque, the rotational anchoring means allowing the free rotation of the driving element in a second rotation direction opposite to the first rotation direction; and locking means for locking the driving element with driven element for unitary rotation in the second rotation direction, wherein the locking means comprise a key which simultaneously engages the driving element and the driven element in a specific position of the driving element relative to the driven element, fixedly connecting the driving element to the driven element during rotation in the second rotation direction, wherein the key comprises a profiled blade to be inserted in a complementary-shaped seat of the driving element and into a gauged seat of the driven element, and wherein the complementary-shaped seat for the profiled blade of the key is an aperture provided on an outer radial periphery of the driving element and wherein the gauged seat for the profiled blade of the key is a gauged radial cavity of the driven element.

18. The device as claimed in claim 17, wherein the aperture is a slit.

* * * * *